US005147098A

United States Patent [19]

McCrink

[11] Patent Number: 5,147,098

[45] Date of Patent: Sep. 15, 1992

[54] SKI BOOT SCRAPER

[76] Inventor: David J. McCrink, 17 Margaretta Rd., Boonton, N.J. 07005

[21] Appl. No.: 800,022

[22] Filed: Nov. 29, 1991

[51] Int. Cl.[5] ..... A63C 11/18

[52] U.S. Cl. ..... 280/813; 15/237

[58] Field of Search ..... 15/237, 238; 280/809, 280/813, 164.2

[56] References Cited

U.S. PATENT DOCUMENTS

| | | | |
|---|---|---|---|
| 3,284,091 | 11/1966 | Spier | 280/813 |
| 3,826,518 | 7/1974 | Hennig | 280/11.13 |
| 3,999,773 | 12/1976 | Shuttleworth | 280/813 |
| 4,068,339 | 1/1978 | Maruyama et al. | 15/238 X |
| 4,900,061 | 2/1990 | Kozma | 280/813 |
| 4,927,176 | 5/1990 | King et al. | 280/813 |

FOREIGN PATENT DOCUMENTS

| | | | |
|---|---|---|---|
| 2450096 | 4/1976 | Fed. Rep. of Germany | 280/813 |
| 2607760 | 9/1977 | Fed. Rep. of Germany | 280/813 |

*Primary Examiner*—Andres Kashnikow
*Assistant Examiner*—Michael Mar
*Attorney, Agent, or Firm*—Lewis E. Massie

[57] ABSTRACT

A scraping device adhesively mounted on the top surface of a ski for removing ice and snow from the bottom surfaces of a ski boot. The scraping device, with a rectangular base supporting a plurality of vertical segments, symmetrically spaced, is molded from an elastomeric material having sufficient stiffness and elasticity to rotate horizontally under the compressive force of a ski boot. The top surface of each segment having a saw tooth or abrasive surface. The skier scraping the boot while asserting pressure on the scraper is able to remove ice and snow from the bottom surface of the boot.

1 Claim, 1 Drawing Sheet

SKI BOOT SCRAPER

BACKGROUND OF THE INVENTION

1. Field of the Invention

This invention describes a device for removing ice and snow from the bottom surfaces of ski boots to ensure easy and proper mounting into ski bindings. The device is made of an elastomeric material with sufficient stiffness to apply an abrasive action on the snow and ice on the bottom of the ski boot. Removal of the snow and ice on the bottom surface of the ski boot is essential to ensure the proper binding release. Down hill ski bindings work on tension mechanisms designed to release under specific conditions based upon the skier's weight and skill. The ski must be secured into the binding properly so that the tension settings are not altered. When there is a slight amount of ice and snow caked onto the bottom of a ski boot the binding can still be locked onto the boot but the binding tensions are altered. An improper or altered binding setting can cause the binding to release unexpectedly and a surprise binding release can cause an accident in an already dangerous sport.

The skier stepping upon the scraping fixture would compress the scraper causing a rotating scraping pressure to be applied to the bottom of the ski boot thus removing the snow and ice therefrom.

2. Description of the Related Art

U.S. Pat. No. 4,900,061, Kizma discloses a snow removal device comprising a pedestal and a plurality of uptight bristles. The pedestal is secured fixedly to the runner while the bristles are affixed to the pedestal arranged to provide maximum digging action to remove snow and ice, U.S. Pat. No. 3,826,518, Henning describes a boot scraping means for application to a ski comprising an elongated member affixed to the top surface of the ski in front of the toe binding. The member is provided with upwardly projecting parts which extend across the ski in several directions relative to the longitudinal axis of the ski. Frictional engagement of the boot dislodges snow and ice from the boot.

SUMMARY OF THE INVENTION

The instant invention is constructed from an elastomeric material offering compressive elasticity and stiffness sufficient to respond to vertical pressure by offering a rotational pressure scraping action that scrubs the bottom area of the ski boot. The top surface to the ski boot scraper provides an uneven abrasive surface that aids the scrubbing action in dislodging and removing the caked ice and snow on the bottom surface of the ski boot. The ski boot scraper is mounted on the top of each ski in front or behind the bindings by means of an adhesive with the abrasive surfaces upwards, the skier stepping on the device with the toe, mid, and heel sections of the boot. The unique twisting action derived from the compression of the elastomeric construction of the scraper applies an abrasive scraping movement to the top surface of the device, against the bottom surface of the boot.

DETAILED DESCRIPTION OF THE PREFERRED EMBODIMENTS

Figure 1:
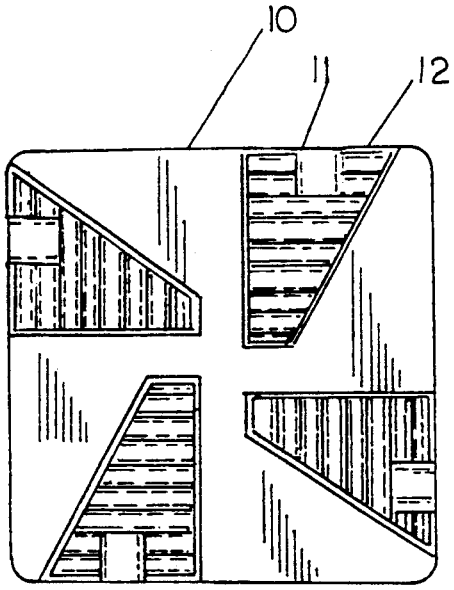
FIG. 1 is a plan view of the ski boot scraper.
Figure 2:
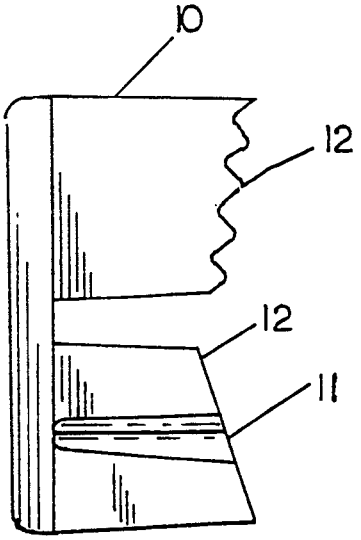
FIG. 2 is a right side elevation of the ski boot scraper, the left side being a mirror image thereof.
Figure 3:
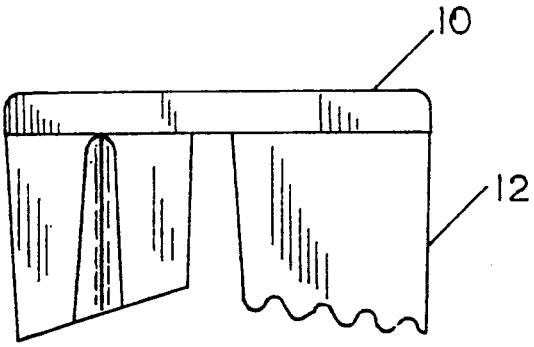
FIG. 3 is a front elevation of the ski boot scraper, the back side being a mirror image thereof.
Figure 4:
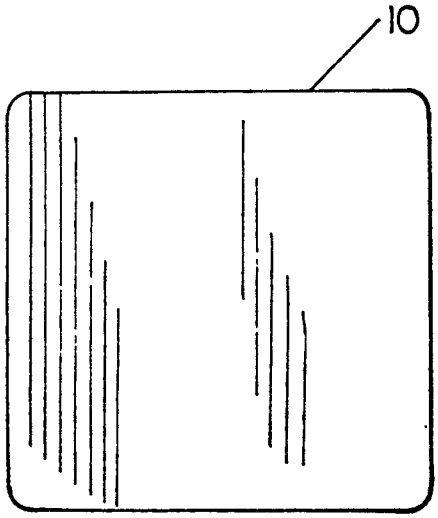
FIG. 4 is a bottom view of the ski boot scraper.

As shown in FIG. 1, the ski boot scraper 10, rectangular shaped in the plan view is molded from an elastomeric material having sufficient elasticity and flexibility to exert a twisting scrubbing action on the bottom of a compressing ski boot. The scraper employs a plurality of "V" shaped, in cross section, symmetrically spaced segments 12, the sloping top surface of which terminate in peaked saw tooth ridges 12. Vertical recesses 11 in the outside surface of each segment provide greater flexibility and increase the tendency for each segment to rotate, or twist, under the compressive force exerted by the ski boot. In use, the ski boot scraper 10 is adhesively fastened, abrasive surface up, to the top surface of the ski in front of, or behind, the ski boot bindings.

I claim:

1. A ski boot scraping device for removing ice and snow from the bottom surface of a ski boot, wherein the improvement comprises:

(a) a base having a top surface, a bottom surface, and four sides, the bottom surface of the base being adapted to be mounted on the top surface of a ski; and (b) four identically shaped segments extending upwardly from the top surface of said base and arranged symmetrically with respect to said four sides, each of said segments having a first vertical wall extending parallel to and along a respective one of said sides, said first vertical wall having a first vertical edge adjacent the center of said side and a second vertical edge adjacent an end of said side, a second vertical wall extending inwardly at a perpendicular angle from the first vertical edge of said first vertical wall, a third vertical wall extending inwardly at an acute angle from the second vertical edge of said first vertical wall, and a fourth vertical wall extending parallel to said first vertical wall and interconnecting innermost edges of said second and third vertical walls, said first vertical wall having a vertical recess extending therein, each of said segments having a top surface which slopes downwardly from said first vertical wall to said fourth vertical wall and being formed with a plurality of saw tooth ridges, wherein said base and said four segments are molded from an elastomeric material having sufficient elasticity to permit compression and rotation of said segments upon downward pressure thereon by the bottom of the ski boot.

* * * * *